United States Patent [19]

Bradley

[11] Patent Number: 4,591,282

[45] Date of Patent: May 27, 1986

[54] DRIVE MECHANISM FOR A RIBBON DISC

[75] Inventor: John P. Bradley, Versailles, Ky.

[73] Assignee: International Business Machines Corporation, Armonk, N.Y.

[21] Appl. No.: 626,078

[22] Filed: Jun. 29, 1984

[51] Int. Cl.[4] ..... B41J 31/00

[52] U.S. Cl. ..... 400/144.2; 400/191; 192/46

[58] Field of Search ..... 400/191, 194, 201, 202, 400/202.2, 144.2, 185, 208, 16, 17, 21, 196; 192/46, 41 R

[56] References Cited

U.S. PATENT DOCUMENTS

| | | | |
|---|---|---|---|
| 726,235 | 4/1903 | Uhlig | 400/191 |
| 2,506,255 | 5/1950 | Von Kraemer | 400/191 |
| 3,623,582 | 11/1971 | Giger et al. | 192/46 |
| 4,084,680 | 4/1978 | Deetz | 400/17 |
| 4,093,061 | 6/1978 | Horak | 400/194 |
| 4,264,221 | 4/1981 | Habich et al. | 400/144.2 |
| 4,347,008 | 8/1982 | Jagodzinski et al. | 400/208 |
| 4,391,536 | 7/1983 | Muller et al. | 400/202 |

FOREIGN PATENT DOCUMENTS 0046879 3/1982 European Pat. Off. .

3043162 7/1982 Fed. Rep. of Germany .

*Primary Examiner*—Charles A. Pearson

*Attorney, Agent, or Firm*—William J. Dick

[57] ABSTRACT

Disclosed is a drive for a ribbon disc (20) for a printer (10), the printer (10) including a printwheel (12) mounted for rotation on the shaft (15) of a printwheel driver (16) and intermediate a print hammer (18) and print receiving means (40). The printwheel driver (16) is connected to the printwheel (12) for effecting rotation thereto to position predetermined petals (14) of the printwheel (12) opposite the hammer (18). A ribbon disc (20) is interposed intermediate the printwheel (12) and the print receiving means (40) and clutch means (31), in one embodiment, is connected to the shaft (15) for coupling and uncoupling the ribbon disc (20) to and from the printwheel driver (16) dependent upon the direction of rotation of the printwheel (12). In a second embodiment, wherein the printwheel is mounted in a protective cartridge (70), the ribbon disc (20) is also mounted in the cartridge (70) and the known biasing spring is modified slightly to form a clutch (75) to first inhibit the rotation of the ribbon disc (20) when the printwheel (12) rotates and allow the rotation of the ribbon disc (20) when the printwheel (12) rotates in the opposite direction.

4 Claims, 4 Drawing Figures

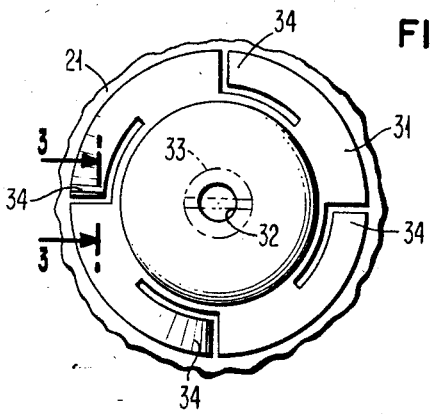
FIG. 2
FIG. 3
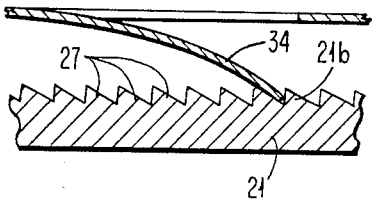
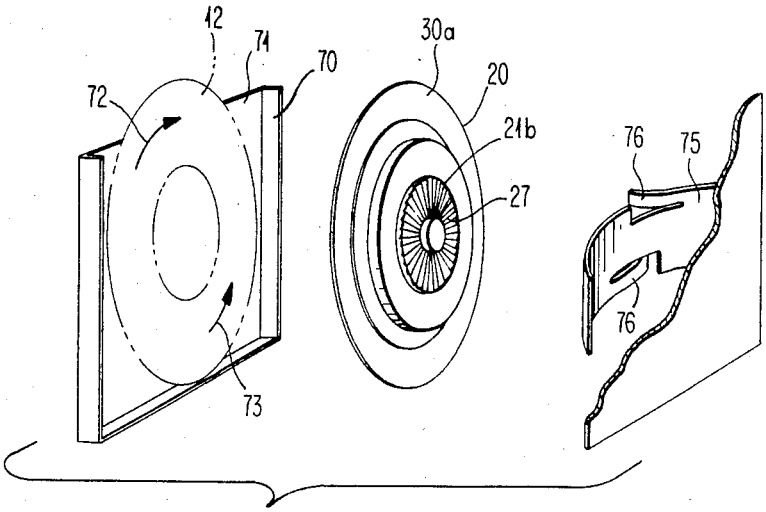
FIG. 4

DRIVE MECHANISM FOR A RIBBON DISC

DESCRIPTION

1. Technical Field of the Invention

The present invention relates to printers and more specifically to print disc drive mechanism for ribbonless-printers in which an inked ribbon disc is placed intermediate a print wheel and a print receiving medium to effect imaging of indicia on the print receiving medium.

2. Background Art

In U.S. Pat. No. 4,093,061 is disclosed an inked ribbon disc for use with a high speed impact printer. The disc is attached to a disc drive motor which effects rotation of the disc, forcing ink through the ribbon and positioning fresh ribbon opposite the printing element. This patent discloses the dedication of a motor for ribbon disc rotation. Alternatively, the present invention utilizes a ribbon disc but employs a single motor drive for a daisy wheel like print element, while utilizing a simple but effective clutch mechanism for insuring random rotation of the print disc to place fresh ribbon intermediate the print element (petal) of the wheel and the print receiving means. In this connection, character uniformity on the print receiving means is achieved by the inked ribbon disc exposing a fresh portion of itself to the print wheel petals during each character printing.

DISCLOSURE OF THE INVENTION

In view of the above, it is a principle advantage of the present invention that a separate drive motor for a ribbon disc is not necessary to effect rotation of the ribbon disc.

Accordingly, it is a distinct advantage of the mechanism of the present invention, that the added cost of a different and separate ribbon drive motor is unnecessary, thus making the mechanism of the present invention economically advantageous.

Additionally, in accordance with this invention, the ribbon disc is randomly repositioned with respect to the printwheel characters, thereby avoiding excessive wear in localized areas which might otherwise be impacted by the more frequently occurring characters.

To this end, and as will be shown hereinafter, in one embodiment of the invention the printing disc is mounted for free and unimpeded rotation on the motor shaft which carries the printwheel of the printer. A clutch device, connected to and mounted on the motor shaft of the printwheel, includes spaced-apart tangs which coact with teeth on the ribbon disc to act as pawls and drive the disc with the printwheel when rotation occurs in one direction, while permitting unimpeded rotation when the direction of the printwheel rotation is in the opposite direction.

In another embodiment of the invention, in those circumstances when the printwheel is mounted in a cartridge, the ribbon disc may also be mounted in the cartridge. In this scheme the cartridge includes a similar clutch in the form of a spring with check pawls which coacts with teeth on the ribbon disc to inhibit rotation of the disc in one direction when the disc tends to rotate due to printwheel-ribbon disc friction, while, when the direction of printwheel rotation is reversed, the ribbon disc tends to rotate therewith.

DRAWING DESCRIPTION

FIG. 2 is a frontal section view taken along line 2—2 of FIG. 1;

FIG. 3 is a fragmentary sectional view taken along line 3—3 of FIG. 2; and FIG. 4 is an exploded perspective view, partially in fragment, of another embodiment of the present invention wherein the printwheel and/or the ribbon disc are mounted in a cartridge for ease of operator insertion into a typewriter or the like.

DETAILED DESCRIPTION OF THE INVENTION

Figure 1:
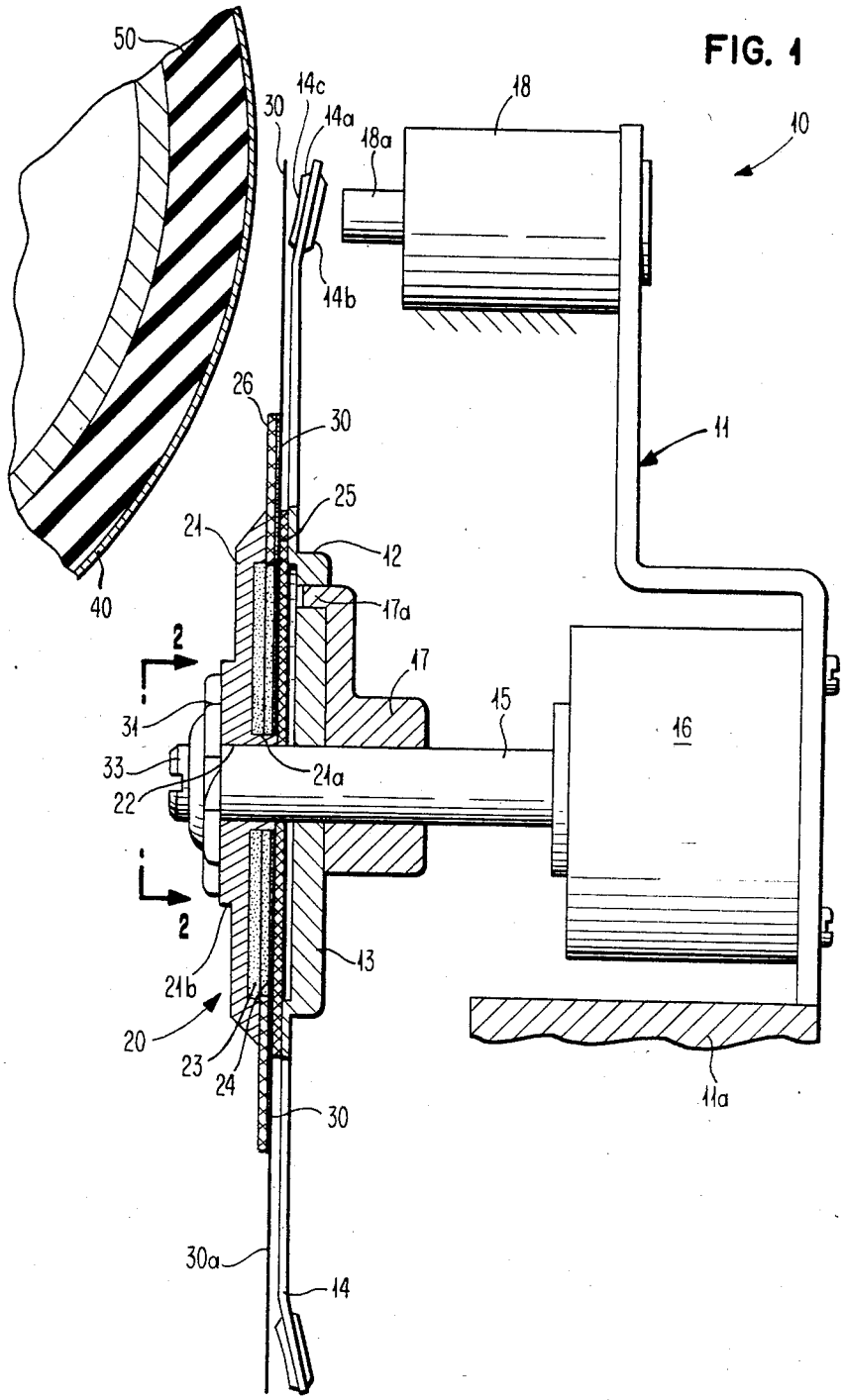
FIG. 1 is an enlarged fragmentary side elevational view of a printwheel and ribbon disc with ribbon drive constructed in accordance with the present invention.

Referring now to the drawings, and especially FIG. 1 thereof, a portion of a printer 10 incorporating one embodiment of the subject matter of the present invention, is shown therein. As illustrated, the print mechanism 11 of the printer is mounted on a print carrier 11*a* and includes a printwheel or daisy wheel 12 which comprises a hub 13 and radially extending petals 14 terminating in indicia bearing pads 14*a*. The hub 13 of the print wheel 12 is connected to the shaft 15 of a print wheel driver 16, in the present instance by a collar 17 which is coupled to the shaft 15. The collar 7, in turn, is connected to the hub 13 of the printwheel 12 by a coupling key or lug 17*a*. Thus, as the shaft 15 rotates, so does the print wheel 12, causing selected petals 14 to be aligned in a predetermined position opposite a print hammer 18, in the illustrated instance a solenoid and the like. When the selected petal is opposite the hammer 18, the hammer is "fired" or actuated causing the hammer tip 18*a* to strike the rear portion 14*b* of the pads 14*a*, pushing the indicia 14*c* on the pad 14*a* against inked ribbon 30 and creating an inked impression against paper or other print receiving medium 40. As is conventional in printing mechanism, the print receiving medium 40 may be carried by a platen 50.

In accordance with the invention, the print ribbon 30 is carried in a ribbon disc 20 which is rotated semi-randomly with the rotation of the print wheel 12. This insures a fresh portion of the ribbon 30 is positioned opposite the indicia bearing pad 14*a* of the selected petal 14 of the print wheel 12 when it is desired to print, as outlined above.

To this end, the ribbon disc 20 comprises a cylindrical housing 21 having a central hub portion 21*a* with a central aperture 22. The central aperture 22 has a slightly larger diameter than the shaft 15 so as to be freely rotatable with respect to the shaft 15. In the illustrated instance, the housing 21 defines a chamber 23 with a radially extending disc-like wick 24 to hold therein a supply of ink. The wick 24, in conjunction with a ribbon support film 25, acts as a sandwich to embrace therebetween the ribbon 30. The ribbon support 25 may be composed of a somewhat stiff material such as "Mylar" resin or "Kapton" resin film having a thickness of approximately 0.008 inches or more and bonded to the shaft embracing hub 21*a* of the housing 21 at the margin thereof. The ribbon support film 25 has preferably a low co-efficient of friction so that the hub 13 of the printwheel 12 bearing against the film 25 will effect insufficient frictional bearing surface to cause locked rotation of the ribbon disc 20 with the printwheel 12. For support purposes, a second annular disc 26 may be provided intermediate the housing 21 and the wick 24 to add support to the ribbon 30 as well as the wick 24. As shown, the ribbon 30 extends radially outward of the support 25 to expose a portion 30*a* thereof for print hammer impact. The ribbon 30 may be composed of any self-supporting standard ink wettable material such as fabric.

In order that the characters being printed on the print receiving medium 40 are crisp and of a uniform density, it is essential that a different portion of the ribbon 30 usually be interposed between the printwheel 12 and the print receiving medium for each character printed. In accordance with the present invention, a clutch 31 (see FIG. 2) is secured as through a central aperture 32 and screw 33 to the shaft 15. As illustrated, the clutch 31 has a greater diameter than the diameter of the shaft 15. Additionally, the clutch 31 includes a disc or the like body with circumferentially spaced apart pawl portions or tangs 34, in the present instance bent out of the plane of the main body of clutch 31 towards the ribbon disc 20. On the ribbon disc 20, in the illustrated instance on the protruding hub 21*b* of the housing 21, is disposed a plurality of teeth, in the illustrated instance ratchet-like teeth 27 (FIG. 3) for engagement or coaction with the tangs 34 on the clutch 31. The tangs 34, as will be described hereinafter, act as pawls, and the clutch 31 serves to lightly bias the ribbon disc 20 towards the collar 17 and lug 17*a* thereof.

By the structure described above, when the printwheel 12 is rotated in a first direction, if the spring-like tangs 34 of the clutch 31 engage the teeth 27 (such as illustrated in FIG. 3) so as to push against the teeth, rotation of the ribbon disc will occur concomitantly with the rotation of the printwheel 12. Alternatively, if during character selection the printwheel is turned in the opposite direction, the inertia of the ribbon disc will cause it to slip on the shaft 15 and only a partial movement at most will occur. In either event, a fresh portion of ribbon 30 is normally presented opposite the hammer 18 for coaction with the pad 14*a* of the selected print petal 14. In this manner, inasmuch as direction of rotation of the printwheel 12 depends (as is conventional) upon the shortest distance between adjacent selected characters held on the petals, a semi-random rotation of the ribbon disc 20 occurs during most normal printing.

To assure rotation of the ribbon disc 20 when a single character is used repeatedly (such as during an underscore operation), an extra printwheel motion may be provided between printed characters. For example, the printwheel 12 may be rotated to place the adjacent character on the adjacent petal in front of the hammer and then return to the desired character to be printed. This additional printwheel motion will cause the print disc 20 to rotate slightly resulting in an even distribution of ink usage around the ribbon.

In printers employing a printwheel cartridge such as disclosed in U.S. Pat. No. 4,370,071, issued on Jan. 25, 1983, the ribbon disc 20 may be mounted interiorly of the cartridge 70 adjacent to the printwheel 12. The design of the ribbon disc 20 remains the same, but the clutch 75 may be integrated with the existing pressure and bias spring in a manner such as illustrated in FIG. 4. To this end, the clutch 75 is in the form of the existing bowed spring and includes bent fingers or tangs 76 for engagement with the ratchet like teeth 27 of the hub 21*b*.

In this connection, the printwheel 12 may be connected through the forward wall 71 of the cartridge 70 to the shaft 15 of the printwheel driver 16. Because of the biasing action of the clutch 75 pushing the ribbon disc, which is also mounted for rotation on the shaft 15 of the motor driver 16, against the printwheel 12, the frictional engagement between the printwheel 12 and the ribbon disc 20 normally would cause rotation of the ribbon disc concomitantly with rotation of the printwheel. However, the tangs 76 act as check pawls against the teeth 27 on the hub 21*b* of the ribbon disc 20, impeding rotation of the ribbon disc when the printwheel 12 rotates in a direction such as shown by the arrow 72. Alternatively, when rotation of the print wheel 12 is effected in the direction of the arrow 73, the tangs 76, acting as pawls, slide over the teeth 27 of the ribbon disc 21*b*, the frictional engagement between the ribbon disc 30 and the printwheel 12 being sufficient to effect rotation of the ribbon disc to present a new portion of the ribbon to the printhammer.

As in the instance of the embodiment illustrated in FIGS. 1–3, to assure rotation of the ribbon disc 20 when a single character is used repeatedly, an extra printwheel motion may be provided between printed characters.

It should be recognized that the ribbon disc may take any of a number of forms, the form illustrated being preferred. However, with sight modification, the form of the ribbon disc illustrated in U.S. Pat. No. 4,093,061 may be employed.

Although the invention has been described with a certain degree of particularity, it is understood that the present disclosure has been made only by way of example and that numerous changes in the details of construction and the combination and arrangement of parts may be made without departing from the spirit and scope of the invention as hereinafter claimed:

What is claimed is:

1. A drive for a ribbon disc on an impact printer, said printer including a printwheel mounted for rotation intermediate a print hammer and print receiving means; drive means connected to said printwheel for effecting rotation thereto to position selected petals of said printwheel opposite the hammer; a ribbon disc intermediate said printwheel and said print receiving means and mounted for rotation in a cartridge in frictional engagement with said printwheel, clutch means for coupling and uncoupling said ribbon disc to and from said drive means dependent upon rotation in one or the other of a first or second direction, said clutch means including means rigidly mounted on said cartridge to engage said ribbon disc and inhibit rotation thereof when said printwheel is rotated in said first direction by said drive means; said means on said cartridge permitting rotation of said ribbon disc when rotation of said printwheel is in said second direction, which is opposite to said first direction.

2. A drive for a ribbon disc in accordance with claim 1, wherein said ribbon disc includes a housing mounted for rotation with respect to said drive means, said housing including a chamber for holding a supply of ink, and a wick adjacent said chamber, in intimate contact with said ink; and print ribbon radially extending from said housing, at least a portion of which is in intimate contact with said wick.

3. A drive for a ribbon disc in accordance with claim 2 including a thin, disk-like ribbon support adjacent said ribbon and connected to said housing, said ribbon support being in contact with said ribbon on one side thereof and for contact with said printwheel on the opposite side thereof.

4. A drive for a ribbon disc in accordance with claim 1 wherein said clutch means includes a bowed spring portion for biasing said ribbon disc against said printwheel.

* * * * *